US010278562B2

(12) United States Patent
Mun

(10) Patent No.: US 10,278,562 B2
(45) Date of Patent: May 7, 2019

(54) WEIGHT BALANCE OF DISHWASHER

(71) Applicant: LG Electronics Inc., Seoul (KR)

(72) Inventor: Seongwon Mun, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 15/753,069

(22) PCT Filed: Aug. 10, 2016

(86) PCT No.: PCT/KR2016/008791

§ 371 (c)(1),
(2) Date: Feb. 15, 2018

(87) PCT Pub. No.: WO2017/030316

PCT Pub. Date: Feb. 23, 2017

(65) Prior Publication Data

US 2018/0228342 A1 Aug. 16, 2018

(30) Foreign Application Priority Data

Aug. 17, 2015 (KR) ..... 10-2015-0115262

(51) Int. Cl.
*A47B 77/06* (2006.01)
*A47L 15/42* (2006.01)

(52) U.S. Cl.
CPC ..... *A47L 15/427* (2013.01)

(58) Field of Classification Search
CPC ..... A47L 15/427; D06F 37/42; D06F 39/001; D06F 39/12
See application file for complete search history.

(56) References Cited

U.S. PATENT DOCUMENTS 5,735,589 A * 4/1998 Herrmann ..... B29C 33/123 108/102
5,741,054 A * 4/1998 Becker ..... A47L 15/4253 134/201

(Continued)

FOREIGN PATENT DOCUMENTS

DE 10240364 3/2004
EP 2286709 A1 2/2011

(Continued)

OTHER PUBLICATIONS

International Search Report and Written Opinion in International Application No. PCT/KR2016/008791, dated Dec. 26, 2016, 13 pages.

(Continued)

*Primary Examiner* — Matthew W Ing
(74) *Attorney, Agent, or Firm* — Fish & Richardson P.C.

(57) ABSTRACT

Disclosed is a dishwasher comprising a dishwasher comprising a cabinet comprising a lateral panel and a top panel for defining an exterior appearance, a tub provided in the cabinet and providing a washing space, a door coupled to a front of the tub and opening and closing the washing space, and a weight balance coupled to a top surface of the tub and preventing the cabinet from tumbling down when the door is open, wherein the weight balance comprises a body coupled to the top surface of the tub, and an extended portion extended from each of lateral surfaces of the body and spaced a preset distance apart from the lateral panel.

12 Claims, 11 Drawing Sheets

(56) References Cited

U.S. PATENT DOCUMENTS

| | | | | |
|---|---|---|---|---|
| 7,014,281 | B2 * | 3/2006 | Wuestefeld | A47L 15/4265 126/194 |
| 2010/0282940 | A1 * | 11/2010 | Jerg | A47L 15/427 248/680 |

FOREIGN PATENT DOCUMENTS

| | | | | |
|---|---|---|---|---|
| EP | 2520210 | | 11/2012 | |
| JP | 2001137597 | A1 | 5/2001 | |
| KR | 2004023102 | A1 | 3/2004 | |
| WO | WO2005124008 | A1 | 12/2005 | |
| WO | WO-2012084470 | A1 * | 6/2012 | A47L 15/4253 |

OTHER PUBLICATIONS

European Extended Search Report in European Application No. 16837258.9, dated Jan. 7, 2019, 6 pages.

* cited by examiner

[Fig. 1]
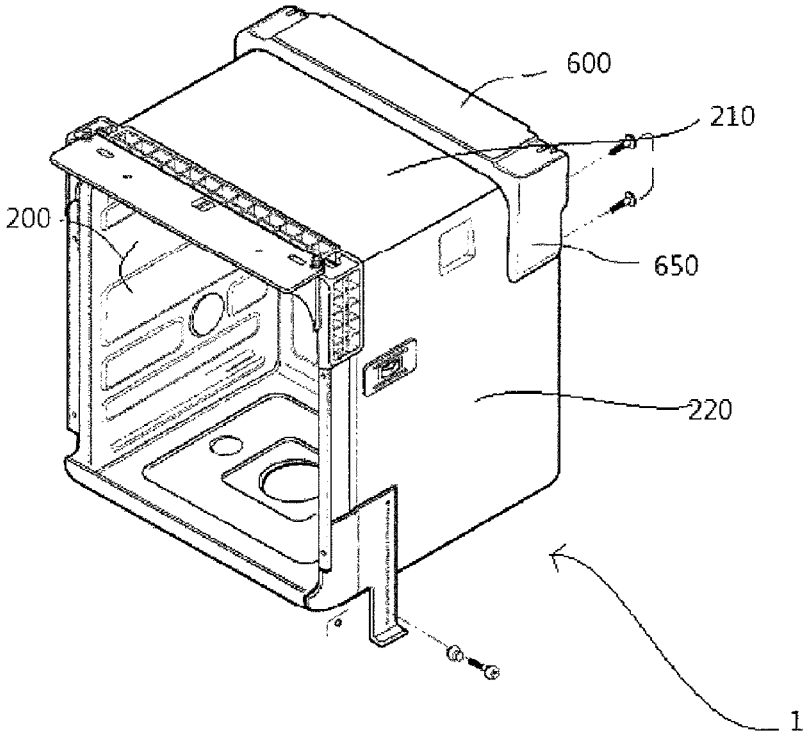

[Fig. 2]
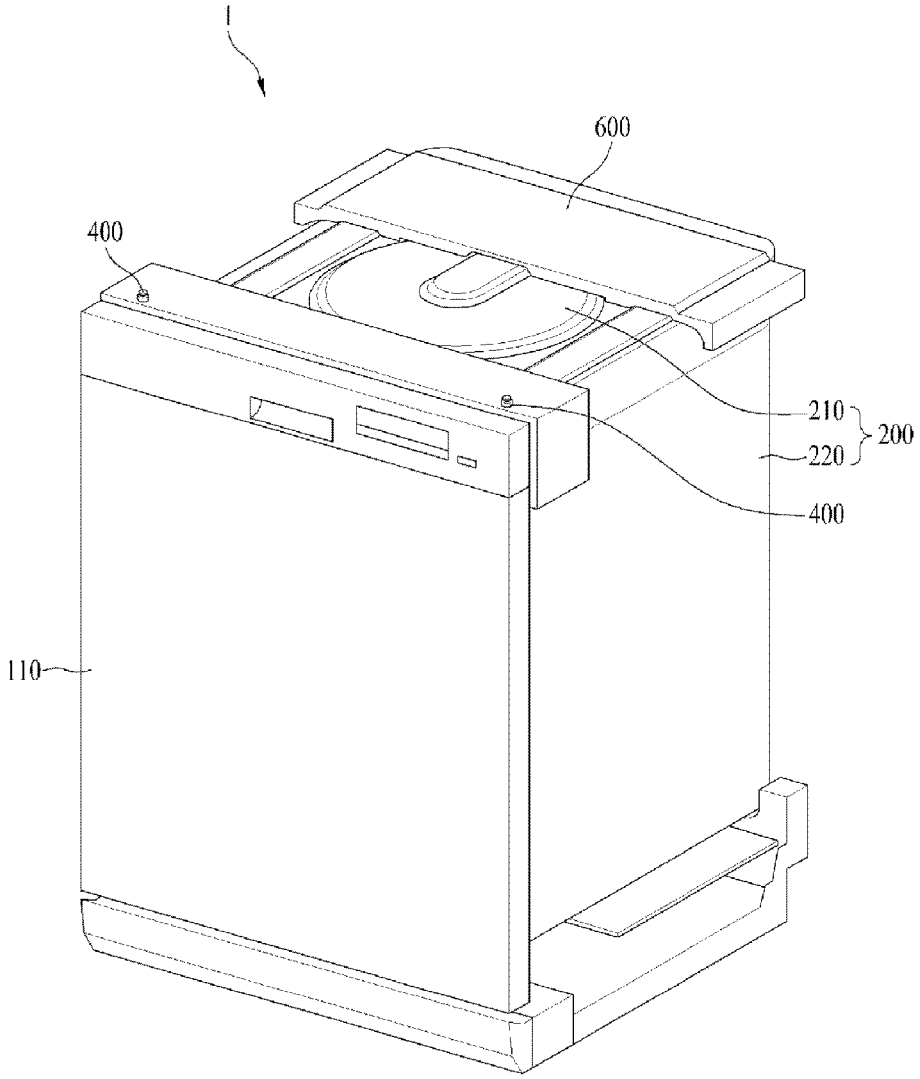

[Fig. 3]
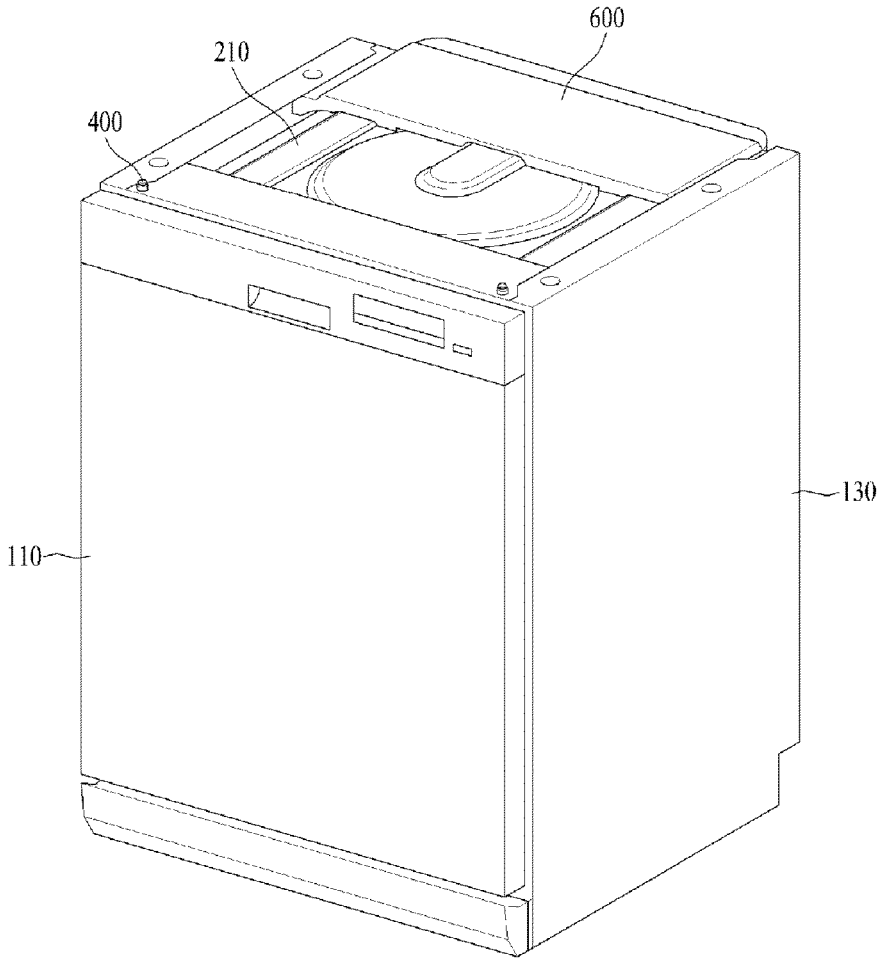

[Fig. 4]
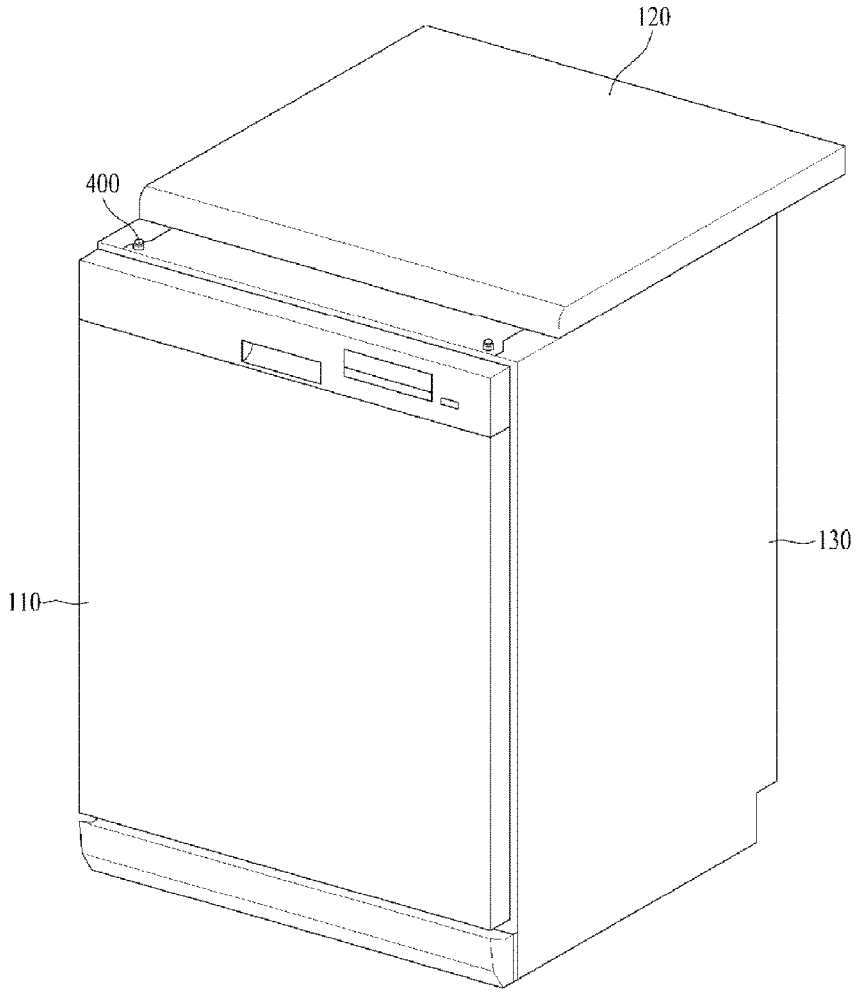

[Fig. 5]
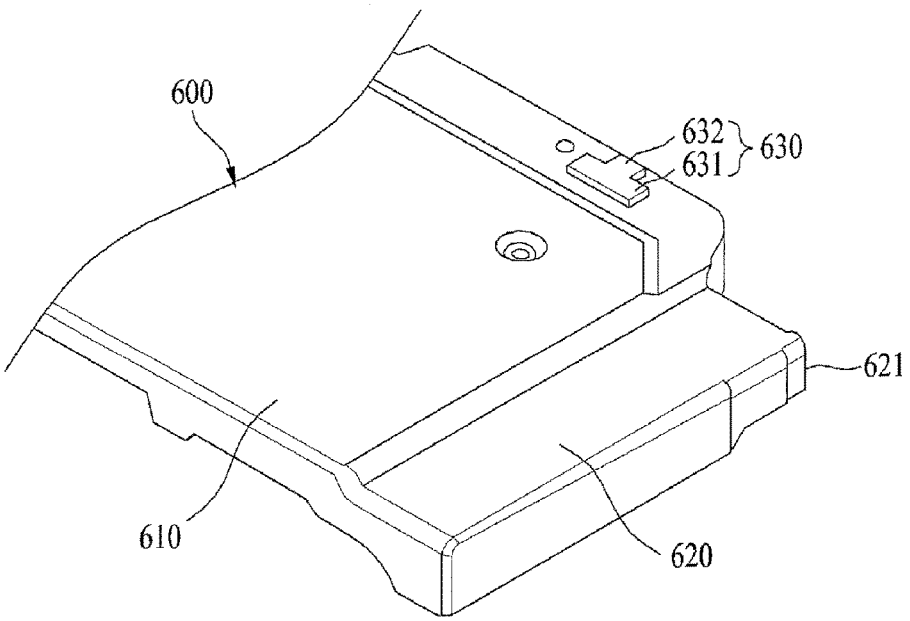

[Fig. 6]
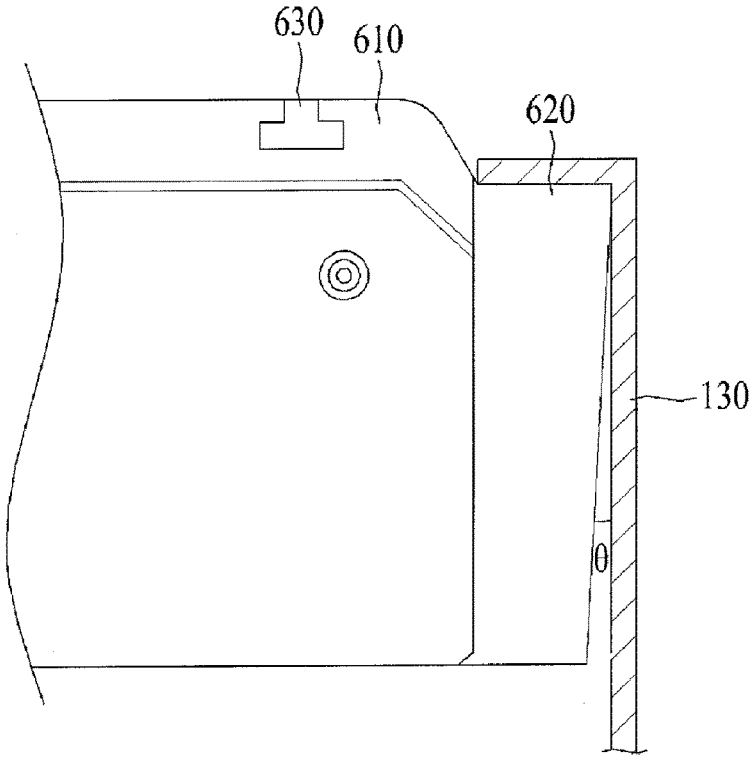

[Fig. 7]
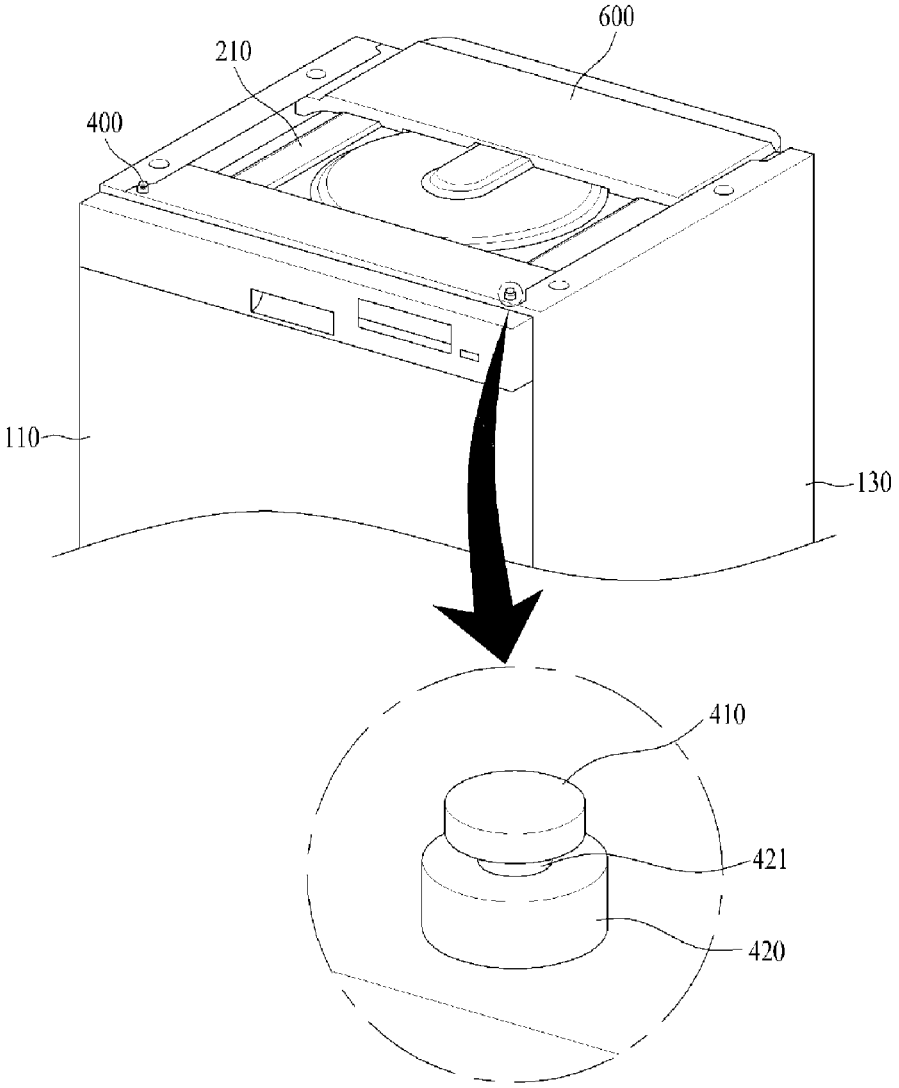

[Fig. 8]
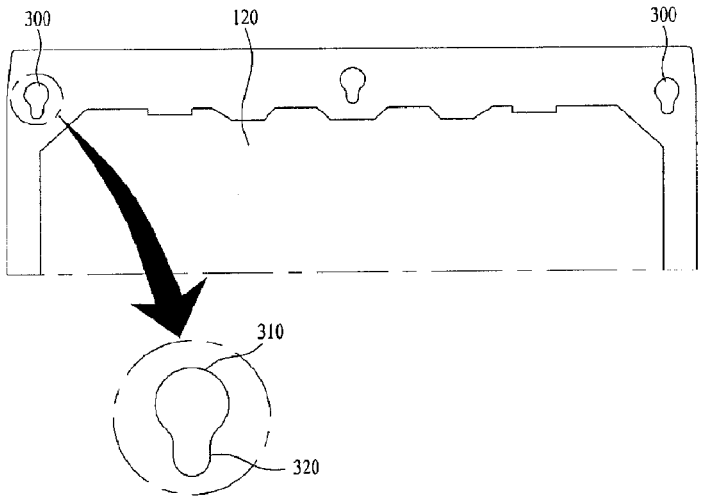

[Fig. 9]
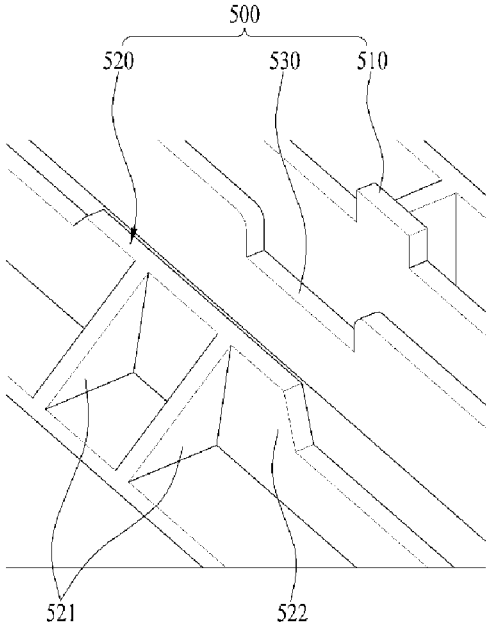
(a)
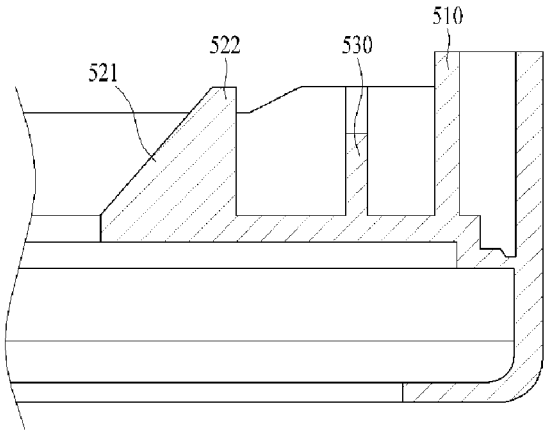
(b)

[Fig. 10]
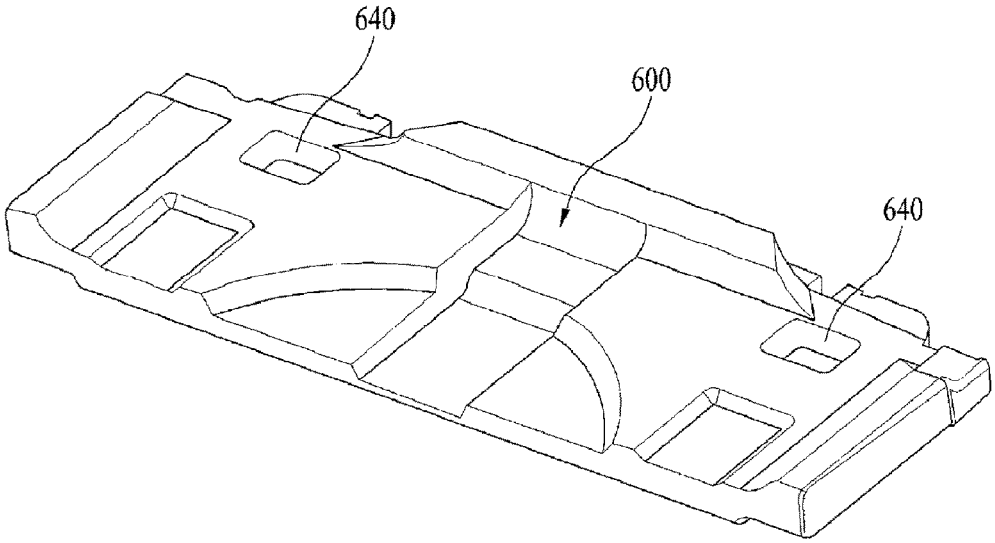

[Fig. 11]
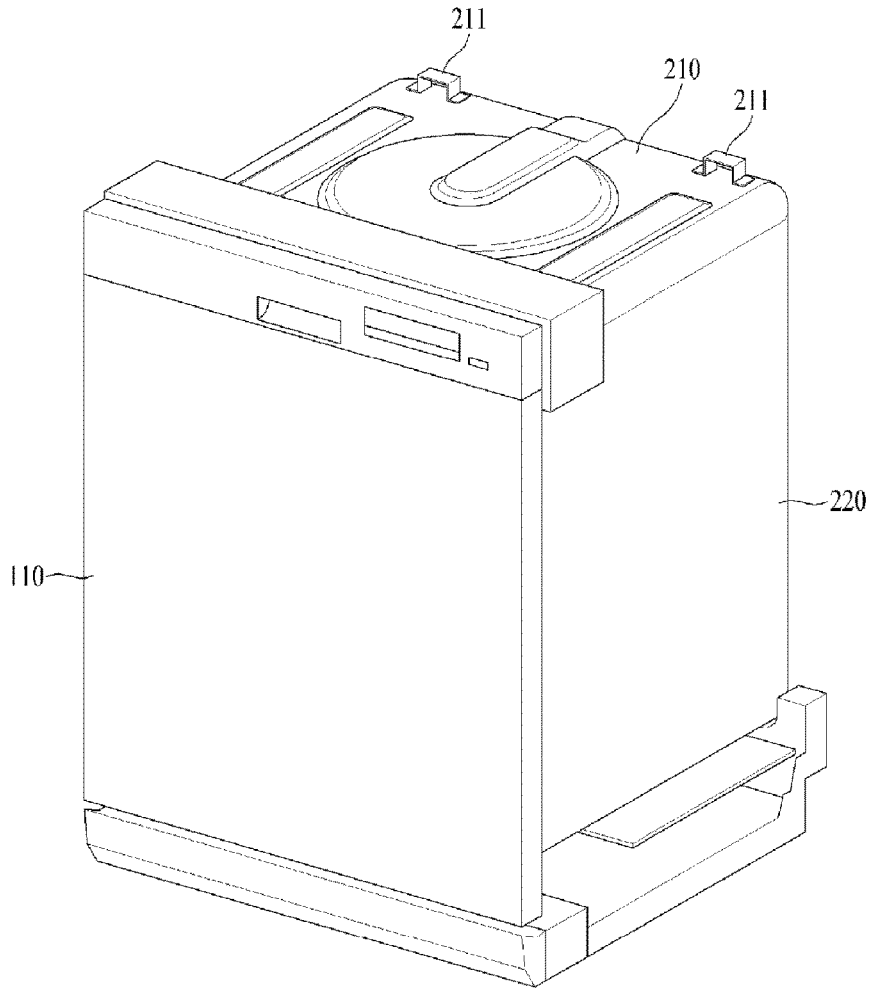

WEIGHT BALANCE OF DISHWASHER

CROSS-REFERENCE TO RELATED APPLICATIONS

This application is a National Stage application under 35 U.S.C. § 371 of International Application No. PCT/KR2016/008791, filed on Aug. 10, 2016, which claims the benefit of Korean Application No. 10-2015-0115262, filed on Aug. 17, 2015. The disclosures of the prior applications are incorporated by reference in their entirety.

TECHNICAL FIELD

The present disclosure relate to a weight balance structure of a dishwasher.

BACKGROUND ART

Embodiments of the present disclosure relate to a weight balance structure of a dishwasher, more particularly, to a shape and structure of a weight balance which supports a case from falling down or tumbling when a door is open and closed. Generally, a dishwasher is the apparatus configured to remove food scraps which remains on dishes or cooking tools (hereinafter, washing objects) using the wash water injected from an injection nozzle.

A conventional dishwasher includes a tub in which a washing tank is formed and a sump mounted in a bottom surface of the tub to store washing water. The washing water is supplied to an injection nozzle by the pumping performance of a washing pump mounted in the sump and the washing water supplied to the injection nozzle is injected at a high pressure via an injection hole formed in an end of the injection nozzle. The washing water injected at the high pressure is hit against surfaces of dishes and contaminants such as food scraps remaining on dishes then fall down to a bottom of the tub.

Meanwhile, a weight balance is mounted to a rear portion of a top surface of the tub in the conventional dishwasher to prevent the dishwasher from falling down in a state where the door is open completely. In other words, the weight balance having a preset weight is mounted to a rear portion of the tub so as to damp the moment causing the falling-down of the dishwasher so that the dishwasher can be balanced.

FIG. 1 is an exploded perspective diagram schematically illustrating the exterior appearance of the conventional dishwasher in which such a weight balance is mounted.

Referring to FIG. 1, the conventional dishwasher 1 includes a tub 200 having a washing tank formed therein; and a weight balance 600 mounted in a rear top surface 210 of the tub 200.

The weight balance 600 consists of a body unit 610 coupled to the rear top surface 210 of the tub and a top cover guide 650 coupled to a rear lateral surface 220 of the tub.

A cabinet (not shown) is secured to an outer circumferential surface of the top cover guide 650 and a certain space is then formed between the tub 200 and the cabinet 100.

However, if the conventional dishwasher happens to tumble horizontally while moved from a production line to a transporting vehicle or carried in a transporting vehicle, quite an external shock is applied to a lateral panel 130 in contact with the top cover guide 650.

Accordingly, there might be certain stabbed portion or scratch caused in the lateral panel 130 by the top cover guide 650 and there are frequent consumers' demands for returns and exchanges.

The current trend is toward the maximized volume of the tub without increasing the overall size of the dishwasher. The thickness of the top cover guide 650 has to be reduced as much as possible to maximize the volume of the tub 200 without changing the size of the exterior appearance of the dishwasher.

Moreover, if the conventional dishwasher is turned over or falling down on the face or forward during the transportation process, the top panel 120 is likely to be separated from the top piece 210 of the tub or shaken horizontally by the external shock.

DISCLOSURE OF INVENTION

Technical Problem

To overcome the disadvantages, an object of the present disclosure is to provide a dishwasher which may solve the stabbed or scratched portion of a lateral panel caused by a weight balance if tumbling or falling down.

Another object of the present disclosure is to provide a dishwasher which prevents a top panel from getting separated from a top surface of a tub or shaking horizontally, if tumbling or falling down.

A further object of the present disclosure is to provide a dishwasher which maximizes the volume of a tub without increasing the overall size.

Solution to Problem

To achieve these objects and other advantages and in accordance with the purpose of the embodiments, as embodied and broadly described herein, a dishwasher comprises a cabinet comprising a lateral panel and a top panel for defining an exterior appearance; a tub provided in the cabinet and providing a washing space; a door coupled to a front of the tub and opening and closing the washing space; and a weight balance coupled to a top surface of the tub and preventing the cabinet from tumbling down when the door is open, wherein the weight balance comprises a body unit coupled to the top surface of the tub; and an extended portion extended from each of lateral surfaces of the body unit and spaced a preset distance apart from the lateral panel.

The extended portion may be inclined toward the body unit.

The extended portion may be inclined to get narrower toward a front portion from a rear portion of the tub.

One or more projections may be provided in a front portion of the top surface of the tub, and one or more projection grooves having the one or more projections coupled thereto are provided in the top panel.

The projection may comprise a column portion provided in a top surface of the tub; and a head portion extended from the column portion and comprising a groove portion smaller than a diameter of the column portion and a free end extended from the groove portion, the head portion having a diameter larger than the groove portion, and the projection groove may comprise an inserting portion having the head portion inserted therein; and a guide portion extended from the inserting portion backward with respect to the front of the tub, the guide portion having the width smaller than a diameter of the inserting portion, and the top panel may be slidingly coupled to the top surface of the tub toward a front portion from a rear portion of the tub.

The body unit may comprise a projected portion projected from a rear end of a top surface, and the top panel may comprise a support portion provided in a rear portion of a bottom surface and preventing the top pane from separating from the top surface of the tub by accommodating the projected portion.

The support portion may comprise a rear limiting portion supporting the projected portion backward; and a front limiting portion supporting the projected portion forward.

The front limiting portion may comprise an inclined rib guiding the projected portion to slidingly move into the support portion.

The front limiting portion may further comprise a front rib vertical with respect to the inclined rib and the top panel.

The support portion may comprise a lateral limiting portion provided between the front limiting portion and the rear limiting portion and supporting a lateral side of the projected portion.

The weight balance may comprise a recessed portion provided in a bottom surface of the body unit, and the tub may comprise an inserting portion provided in the top surface and inserted in the recessed portion.

Further scope of applicability of the present invention will become apparent from the detailed description given hereinafter. However, it should be understood that the detailed description and specific examples, while indicating preferred embodiments of the invention, are given by illustration only, since various changes and modifications within the spirit and scope of the invention will become apparent to those skilled in the art from this detailed description.

Advantageous Effects of Invention

The embodiments have following advantageous effects. The dishwasher in accordance with the present disclosure may solve the disadvantage of the stabbed or scratched portion of the lateral panel by the weight balance if the dishwasher is tumbling or falling down.

The dishwasher may prevent the top panel from getting separated from the top surface of the tub or shaking horizontally, if tumbling or falling down.

The dishwasher may minimize the guarantee service cost caused by the malfunctions generated in the transportation of the dishwasher.

The dishwasher may maximize the volume of a tub without increasing the overall size.

BRIEF DESCRIPTION OF DRAWINGS

FIG. 1 is a diagram schematically illustrating a conventional dishwasher including a weight balance;

FIGS. 2 through 4 are diagrams illustrating a structure and an assembling process of a dishwasher in accordance with the present disclosure;

FIG. 5 is a perspective diagram of a weight balance provided in the dishwasher;

FIG. 6 is a sectional diagram illustrating a lateral panel coupled to an extended portion of the weight balance;

FIG. 7 is diagram illustrating a projection located in a top surface of a tub;

FIG. 8 is a diagram illustrating a projection groove located in a top panel;

FIG. 9 is a diagram illustrating a support portion of the top panel; and

FIGS. 10 and 11 are diagrams illustrating a recessed portion and an inserting portion for coupling the weight balance and the top surface of the tub to each other.

BEST MODE FOR CARRYING OUT THE INVENTION

Referring to FIG. 2, a dishwasher 1 according to the present disclosure includes a tub for in which a washing space is formed; a door 110 for opening and closing the washing space; and a weight balance 600 provided in a rear end portion of a top surface 210 provided in the tub.

The direction in which the door 100 is provided is defined as a front direction of the dishwasher 1 and the tub 200 and the reverse direction is defined as a rear direction.

The weight balance 600 may be fastened to the top surface 210 of the tub by a bolt.

The weight balance 600 may be made of a material having a high specific gravity and formed in blower molding, so that salt water or sand may be filled in the weight balance 600. The weight balance 600 may be made of any materials only if capable of preventing the tumbling or falling down of the dishwasher 1 by damping the moment when the door 110 of the dishwasher 1 is open.

When the door 110 of the dishwasher 1 is open, the door 110 having quite a weight generates the moment in the direction in which the dishwasher 1 tumbles one the face or front (in other words, forward). At this time, the dishwasher 1 is likely to get tumbled on the front by the moment and the tumbling of the dishwasher might damage the exterior appearance of the dishwasher or incur a risk of a user's physical injury.

To prevent the risk, the weight balance 600 is provided in a rear end portion of the top surface 210 provided in the tub and coupled to the rear end portion of the top surface 210.

The weight balance consistently applies the self-load to the rear end portion of the top surface 210 in a vertical direction and then prevents the dishwasher 1 from tumbling on the front even when the door 110 of the dishwasher lis open.

In this instance, a bottom surface of the weight balance 600 is formed in a corresponding shape to the top surface 210 of the tub, only to be in close contact with the top surface 210 of the tub. The volume of the dishwasher 1 can be reduced or the inflow of foreign substances can be prevented by minimizing the gap between the weight balance 600 and the top surface 210 of the tub.

Referring to FIGS. 2 through 4, the dishwasher 1 in accordance with the present disclosure includes the weight balance 600 coupled to the top surface 210 of the tub, a lateral panel 130 coupled to a lateral surface 220 of the tub, and a top panel 120 coupled to a top surface of the weight balance 600 in a sliding method.

Accordingly, the assembling process of the dishwasher 1 for preventing the tumbling of the dishwasher when the door is open may be performed in a simple assembly line.

Referring to FIG. 5, the structure of the weight balance 600 will be described in detail.

The weight balance 600 may include a body unit 610 defining a main body and coupled to the top surface 210 of the tub; and an extended portion 620 extended from both sides of the body unit.

One or more projected portions 630 may be further provided in a rear end of the body unit 610.

Referring to the following description, the one or more projected portions 630 may prevent the top panel 120 from getting separated or vertically twisted by the external shock when the top panel 120 is slidingly coupled to the top surface 210 of the tub 200.

The body unit 610 and the extended portion 620 may be located on the same plane.

In this instance, the weight balance 600 is just located on the top surface 210 of the tub not surrounding the tub 200.

That is to say, the weight balance 600 is coupled only to the top surface 210 of the tub, not to the lateral surface 220 of the tub.

In the process of coupling the lateral panel 130 to the lateral surface 220 of the tub 200, the lateral panel 130 may be fastened to a top of the extended portion 620 by a bolt and spaced a preset distance apart from a side of the extended portion 620, not in closely contact.

When the dishwasher 1 is tumbled horizontally, the weight balance 600 may not contact with the lateral panel 130 and no stabbed portion is generated in the lateral panel 130.

The lateral panel 130 may keep the original shape even after the dishwasher 1 is tumbled horizontally.

Meanwhile, as the distance between the extended portion 620 and the lateral panel 130 is getting farther, the effect of preventing the stabbed portion of the lateral panel 130 is getting greater. However, the weight of the weight balance 600 is lessened and the effect of preventing the tumbling of the dishwasher 1 can get smaller when the door 110 is open.

Accordingly, the lateral panel 130 needs to be spaced a preset distance apart from the extended portion 620 while the weight of the weight balance 600 is not reduced.

If the distance from the extended portion 620 to the lateral panel 130 is larger than the area in which the lateral panel 130 is elastically deformed, the external shock generated by the horizontal tumbling of the dishwasher 1 could cause the deformation of the lateral panel 130.

Accordingly, the distance between the extended portion 620 and the lateral panel 130 has to be in the range of the area in which the elastic deformation of the extended portion 620 is generated.

Referring to FIG. 6, the extended portion 620 may be inclined toward the body unit 610 at a preset angle. At this time, the inclination angle (?) of the extended portion 620 may be in a range of the degrees from 1 to 10 with respect to the lateral surface 220 of the tub.

The reduced amount of the weight can be less than the distance between the overall lateral surface of the extended portion 620 and the lateral panel 130.

The weight balance 600 may serve the original function of preventing the tumbling of the dishwasher 1 sufficiently.

In this instance, the inclination may be provided in the direction in which the distance between a left extended portion 620 and a right extended portion 620 becomes narrower as getting closer to the front portion from the rear portion of the tub.

If the inclination is provided in the reverse direction, a corner of the extended portion seems to contact with an internal surface of the lateral panel 130 and the stabbed or scratched portion might be generated.

There is plastic deformation in the area where the lateral panel 130 is bent and the area is less likely to be deformed by the external shock than a central area of the lateral panel 130, so that one corner 621 of the extended portion 620 is allowed to contact with the bent area of the lateral panel 130.

The extended portion 620 may be inclined toward the body unit 610 from the one corner 621.

The internal stabbed portion of the lateral panel 130 may be prevented while the weight of the weight balance 600 is increased.

Although not shown in the drawings, the inclination of the extended portion 620 may be curved, not linear. The weight balance 600 may become heavier than the inclination is linear.

Referring to FIG. 7, the projection 400 provided in the top surface 210 of the tub will be described.

One or more projections 400 may be provided in a front end of the top surface 210 of the tub.

The projection 400 may allow the top panel 120 to be detachably coupled to the top surface 210 of the tub 200.

The projection 400 may be extended from a front end of the top surface or an auxiliary frame provided in the top surface 210 of the tub.

In other words, the projection 400 may be projected from the front end of the top surface 210 provided in the tub and other areas.

Two projections 400 may be provided in both edges of the front end, respectively.

Referring to FIG. 7, the projection may include a head portion 410 coupled to the top panel 120 and a column portion 420 extended from the head portion 410 to the front end of the top surface 210 of the tub.

The column portion 420 may include a groove portion 421 which is smaller than a diameter of the head portion 410.

Referring to FIG. 8, the lower structure of the top panel will be described.

The top panel 120 may include a projection groove 300 provided in a front portion of a bottom surface and having the projection 400 insertedly coupled thereto.

The projection groove 300 includes an inserting portion 310 in which the head portion 410 of the projection is inserted and a guide portion 320 guiding the projection 400 by getting insertedly fitted in the groove portion 421 of the projection 400.

The guide portion 320 may be provided as a slit extended from one side of the inserting portion 310 toward the rear portion of the tub 200.

When the top panel 120 is coupled to the top surface 210 of the tub, the projection 400 is inserted in the inserting portion 310 and the guided to the guide portion 320 so as to slidingly couple the top panel 120 to the top surface 210 of the tub (see FIG. 4).

Referring to FIG. 9, a support portion of the top panel 120 will be described.

FIG. 9*a* is a perspective diagram of the support portion 500 and FIG. 9*b* is a sectional diagram of the support portion 500.

The sliding movement is applied to the top panel 120 so as to detachably coupling the top panel 120 to the top surface 210 of the tub 200. Accordingly, the coupling and decoupling of the top panel 120 is easily performed.

However, the top panel 120 might be separated from the tub 200 by the external shock generated if the dishwasher 1 is tumbled on the front or forward in the production line or transporting process.

The top panel 120 might be re-sliding backward from the top surface 210 of the tub 200 to be separated when the dishwasher 1 tumbles.

If the dishwasher 1 tumbles horizontally, the top panel 120 moves in the top surface 210 of the tub horizontally.

Accordingly, a support portion 500 may be provided in a rear end of the bottom surface of the top panel 120 to solve the disadvantage.

The support portion 500 may support the projected portion 630 of the weight balance 600 to prevent the top panel 120 from separating or moving from the top surface 210 of the tub even if the dishwasher 1 tumbles.

The support portion 500 may include a rear restricting portion 510 for supporting the projected portion 630 backward when the top panel 120 is coupled to the top surface 210 of the tub; and a front limiting portion 520 for supporting the projected portion 630 forward.

The rear limiting portion 510 may be provided as a rib projected vertically and serve as limit line for limiting the forward movement of the top panel 120 by supporting the rear end of the projected portion 630 when the top panel 120 is slidingly coupled to the top surface 210 of the tub.

The rear limiting portion 510 prevents the top panel 120 from separating forward when the dishwasher 1 tumbles by supporting the rear end of the projected portion 630.

The front limiting portion 520 includes one or more inclined ribs 521 to facilitate the receiving of the projected portion 630 in the support portion 500 smoothly when the top panel 120 is sliding backward from the top surface 210 of the tub.

The inclined rib 521 is projected from the bottom surface of the top panel 120 vertically and projected backward with respect to the front portion of the top panel 120. The inclined rib 521 includes the inclination toward the rear portion from the front portion of the top panel 120.

When the top panel 120 is sliding to the top surface 210 of the tub, the inclined rib 521 is sliding along the top surface of the projected portion 630 forward from a rear portion of the top surface.

That is to say, the projected portion may be disposed between the front limiting portion 520 and the rear limiting portion 510 when reaching the rear limiting portion 510 after passing the inclined rib 521.

The highest portion of the inclined rib supports the front portion of the projected portion 630 so as to prevent the top panel 120 from becoming pushed backward even if the dishwasher 1 tumbles or an external force is applied to the dishwasher 1.

The forward limiting portion 522 may prevent the top panel 120 from being pushed backward more effectively by supporting the front portion of the projected portion 630, when the projected portion 630 is disposed between the front limiting portion 520 and the rear limiting portion 510.

The support portion 500 may further include a lateral limiting portion 530 to prevent the top panel 120 from moving horizontally when the projected portion 630 is insertedly disposed.

The lateral limiting portion 530 may be provided between the front limiting portion 520 and the rear limiting portion 510 and as a rib having a groove corresponding to the width of the projected portion 630.

When the projected portion 630 is insertedly disposed in the support portion 500, the lateral limiting portion 530 supports both lateral sides of the projected portion 630 so as to prevent the top panel 120 from moving horizontally even if the dishwasher 1 tumbles or an external shock is applied to the dishwasher 1.

The projected portion 630 may include a first projected portion 631 and a second projected portion 632 extended from one side of the first projected portion and having a different width from the first projection (see FIG. 5).

The second projected portion 632 is extended along a direction toward the rear end of the tub 200.

The first projected portion 631 may be insertedly disposed between the front rib 522 and the lateral limiting portion 530. The second projected portion 632 may be insertedly disposed in the lateral limiting portion 530.

Accordingly, when the projected portion 630 is inserted in the support portion 500, the first projected portion 631 is supported by the front rib 522 and the second projected portion 632 is supported by the lateral limiting portion 530 and the rear limiting portion 510, so that the top panel 120 can be prevented from moving in and/or separating from the top surface 210 of the tub more effectively.

As mentioned above, the shape of the projected portion 630 consists of the first projected portion 631 and the second projected portion 632. As one alternative example, the shape of the projected portion 630 may be diverse only if the projection portion may help the top panel 120 to be inserted in the support portion 500 not to move horizontally.

The front limiting portion 520, the rear limiting portion 510 and the lateral limiting portion 530 provided in the support portion 500 may have a corresponding shape to the projected portion 630 to be supported in close contact with the projected portion 630 when the projected portion is insertedly disposed.

In other words, the ribs configurating the front limiting portion 520, the rear limiting portion 510 and the lateral limiting portion 530 are combined with each other to form the support portion r or accommodating portion for accommodating the projected portion 630.

Referring to FIGS. 10 and 11, the example of the weight balance 600 is coupled to the top surface 210 of the tub.

The bottom surface of the weight balance 600 may be corresponding to the top surface 210 of the tub.

The weight balance 600 may be fastened to the top surface 210 of the tub by a bolt. The weight balance 600 has quite a weight for preventing the tumbling of the dishwasher and the bolt might be damaged by the weight if the dishwasher tumbles during the transportation.

In this instance, the weight balance 600 happens to separate or fall down from the top surface 210 of the tub and there is then a high risk of accident.

To prevent the risk, an inserting portion 211 to be inserted in the weight balance 600 may be provided in a rear end of the top surface 210 of the tub and a recessed portion 640 having the inserting portion 211 therein may be provided in the bottom surface of the weight balance 600.

The recessed portion 640 accommodates the inserting portion 211 and the inserting portion 211 supports an internal broad area of the recessed portion 640, so that the weight balance 600 may not separate from the top surface 210 of the tub even if the dishwasher 1 tumbles.

The inserting portion 211 may be made of the same material as the tub 200 and for example, a sheet of steel and stainless steel. The material of the inserting portion 211 may be diverse only if the material has certain rigidity capable of supporting the weight of the weight balance 600.

The shape of the inserting portion 211 may be diversified only if the inserting portion 211 is able to be inserted in the recessed portion 640 and support the weight of the weight balance 600.

The recessed portion 640 and the inserting portion 211 are fitted to each other stably.

While the weight balance 600 is coupled to the top surface 210 of the tub 200, the inserting portion 211 is inserted in the recessed portion 640 and the inserting portion 211 and the recessed portion 640 are fastened to each other by the bolt.

The foregoing embodiments are merely exemplary and are not to be considered as limiting the present disclosure. The present teachings can be readily applied to other types of methods and apparatuses. This description is intended to be illustrative, and not to limit the scope of the claims. Many alternatives, modifications, and variations will be apparent to those skilled in the art. The features, structures, methods, and other characteristics of the exemplary embodiments described herein may be combined in various ways to obtain additional and/or alternative exemplary embodiments. As the present features may be embodied in several forms without departing from the characteristics thereof, it should also be understood that the above-described embodiments are not limited by any of the details of the foregoing description, unless otherwise specified, but rather should be considered broadly within its scope as defined in the appended claims, and therefore all changes and modifications that fall within the metes and bounds of the claims, or equivalents of such metes and bounds, are therefore intended to be embraced by the appended claims.

The invention claimed is:

1. A dishwasher comprising:

a cabinet that defines an exterior appearance of the dishwasher;

a tub provided in the cabinet and providing a washing space;

a door coupled to a front of the tub and opening and closing the washing space; and a weight balance coupled to a top surface of the tub and preventing the cabinet from tumbling down when the door is open, wherein the cabinet comprises:

a top panel that defines an upper surface of the cabinet; and side panels that extend from the top panel and that define side surfaces of the cabinet, respectively, and wherein the weight balance comprises:

a body unit configured to couple to the top surface of the tub; and an extended portion that extends outward from each of side surfaces of the body unit in a direction corresponding to the top panel, that is spaced apart from each of the side panels of the cabinet, and that is configured to not contact side surfaces of the tub.

2. The dishwasher of claim 1, wherein the extended portion is inclined toward the body unit.

3. The dishwasher of claim 2, wherein the extended portion is inclined to get narrower toward a front portion from a rear portion of the tub.

4. The dishwasher of claim 3, wherein one or more projections are provided in a front portion of the top surface of the tub, and one or more projection grooves having the one or more projections coupled thereto are provided in the top panel.

5. The dishwasher of claim 4, wherein the projection comprises a column portion provided in a top surface of the tub; a groove portion extended from the column portion and comprising smaller than a diameter of the column portion; and a head portion provided in a free end extended from the groove portion and having a diameter larger than the groove portion, and the projection groove comprises an inserting portion having the head portion inserted therein; and a guide portion extended from the inserting portion backward with respect to the front of the tub, the guide portion having the width smaller than a diameter of the inserting portion, and the top panel is slidingly coupled to the top surface of the tub toward a front portion from a rear portion of the tub.

6. The dishwasher of claim 5, wherein the body unit comprises a projected portion projected from a rear end of a top surface, and the top panel comprises a support portion provided in a rear portion of a bottom surface and preventing the top panel from separating from the top surface of the tub by accommodating the projected portion.

7. The dishwasher of claim 6, wherein the support portion comprises a rear limiting portion supporting the projected portion backward; and a front limiting portion supporting the projected portion forward.

8. The dishwasher of claim 7, wherein the front limiting portion comprises an inclined rib guiding the projected portion to slidingly move into the support portion.

9. The dishwasher of claim 8, wherein the front limiting portion further comprises a front rib vertical with respect to the inclined rib and the top panel.

10. The dishwasher of claim 9, wherein the support portion comprises a lateral limiting portion provided between the front limiting portion and the rear limiting portion and supporting a lateral side of the projected portion.

11. The dishwasher of claim 1, wherein the weight balance comprises a recessed portion provided in a bottom surface of the body unit, and the tub comprises an inserting portion provided in the top surface and inserted in the recessed portion.

12. A dishwasher comprising:

a cabinet comprising a lateral panel and a top panel for defining an exterior appearance;

a tub provided in the cabinet and providing a washing space;

a door coupled to a front of the tub and opening and closing the washing space; and a weight balance coupled to a top surface of the tub and preventing the cabinet from tumbling down when the door is open, wherein the weight balance comprises:

a body unit coupled to the top surface of the tub; and an extended portion extended from each of lateral surfaces of the body unit and spaced a preset distance apart from the lateral panel, wherein the extended portion is inclined toward the body unit, wherein the extended portion is inclined to get narrower toward a front portion from a rear portion of the tub, and wherein one or more projections are provided in a front portion of the top surface of the tub, wherein one or more projection grooves having the one or more projections coupled thereto are provided in the top panel.

* * * * *